US006796254B2

(12) United States Patent
Bondanza et al.

(10) Patent No.: US 6,796,254 B2
(45) Date of Patent: Sep. 28, 2004

(54) BATCHWISE QUILTING OF PRINTED MATERIALS

(75) Inventors: James Bondanza, Carthage, MO (US); James T. Frazer, N. Olmsted, OH (US); David Brian Scott, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 10/374,577

(22) Filed: Feb. 26, 2003

(65) Prior Publication Data

US 2003/0183147 A1 Oct. 2, 2003

Related U.S. Application Data

(60) Provisional application No. 60/361,127, filed on Mar. 1, 2002.

(51) Int. Cl.[7] ..... D05B 11/00; D05B 21/00; B41M 3/00

(52) U.S. Cl. ..... 112/117; 112/475.02; 112/475.08; 112/470.05; 112/130; 101/35

(58) Field of Search ..... 112/475.08, 475.02, 112/475.03, 475.04, 475.05, 117, 118, 119, 470.05, 470.06, 470.33, 102.5, 304, 307, 322, 2.1; 101/35; 250/548; 347/101, 102; 281/5

(56) References Cited

U.S. PATENT DOCUMENTS 4,067,760 A * 1/1978 Nelson ..... 250/548
5,544,599 A 8/1996 Frazer et al.
5,873,315 A 2/1999 Codos
6,010,156 A * 1/2000 Block ..... 281/2
6,012,403 A 1/2000 Codos et al.
6,158,366 A 12/2000 Codos
6,263,816 B1 7/2001 Codos et al.
6,397,768 B1 * 6/2002 Dasher ..... 112/2.1
6,435,117 B2 8/2002 Codos et al.
6,467,898 B2 * 10/2002 Codos et al. ..... 347/102

* cited by examiner

*Primary Examiner*—Peter Nerbun
(74) *Attorney, Agent, or Firm*—Wood, Herron & Evans, L.L.P.

(57) ABSTRACT

The order in which panels 13 are to be quilted, the amount of quilting-induced shrinkage, and the amount of crop between adjacent panels 13 are stored in a machine readable file 13 for use in operating a print line 10. Such information 13 is printed or otherwise placed on the material 11 at the print line 10 so as to be readable by a sensor 22 at a quilting station, where the information 13 is read and used to control the quilter 21. Panels 15 are quilted according to a schedule and in batches in the most efficient manner, and panels are cut according to information read from records on the material. Shrinkage is compensated for and appropriate crops are made between panels. The printing line prints series of panels on a web 11 in rolls 14 that can be fed, last-printed panel first, into the quilter.

17 Claims, 1 Drawing Sheet

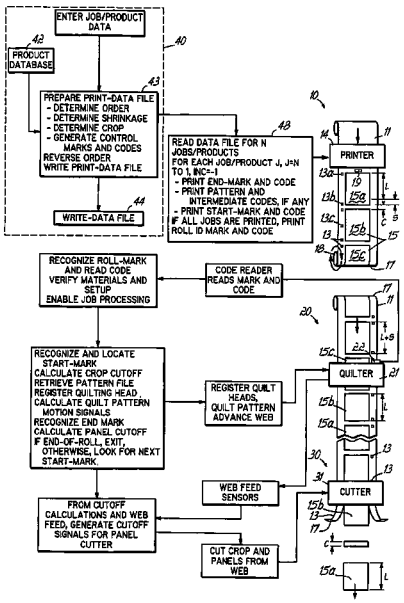

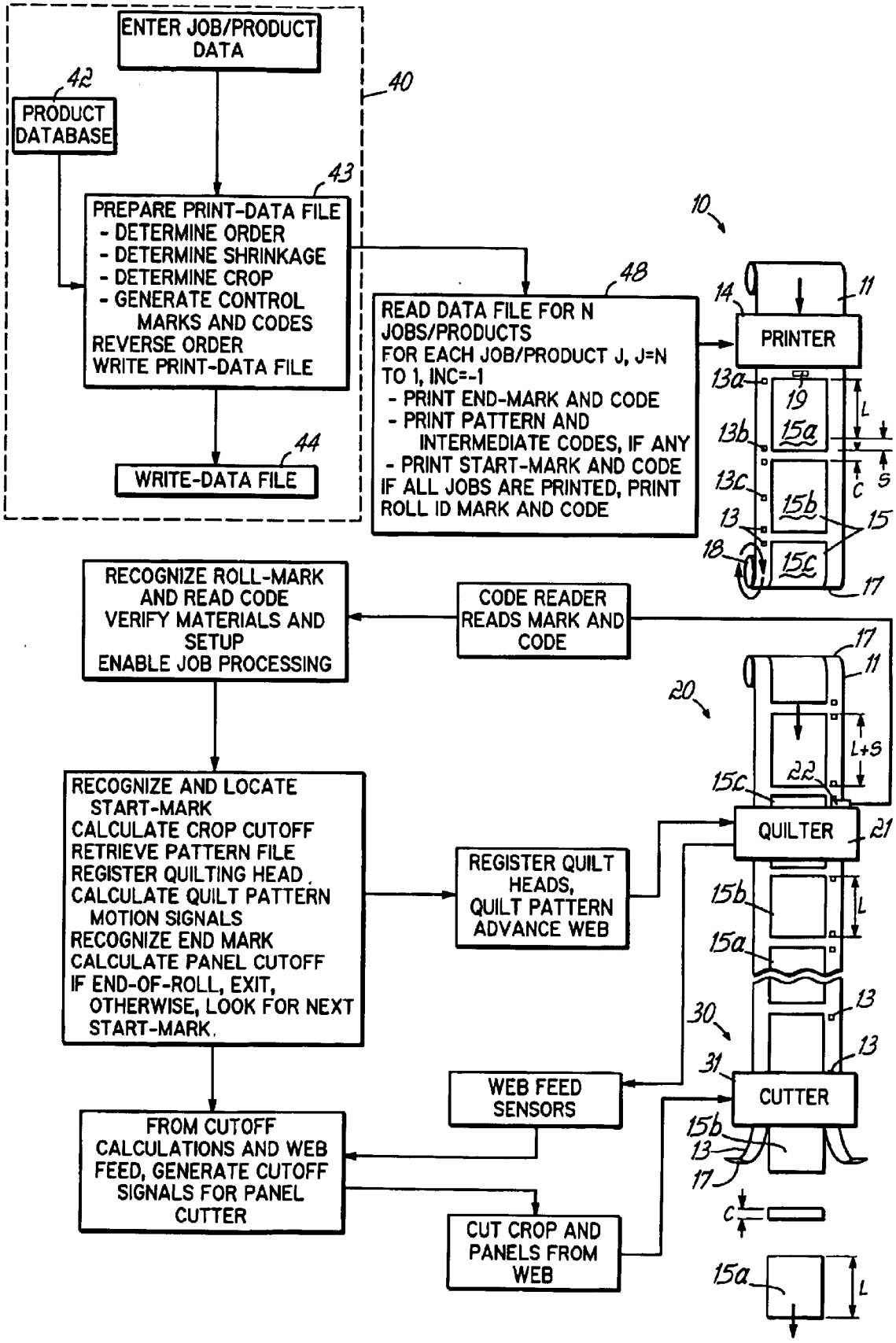
ENTER JOB/PRODUCT DATA
PRODUCT DATABASE
42
40
43
PREPARE PRINT-DATA FILE
- DETERMINE ORDER
- DETERMINE SHRINKAGE
- DETERMINE CROP
- GENERATE CONTROL MARKS AND CODES
REVERSE ORDER
WRITE PRINT-DATA FILE
44
WRITE-DATA FILE
48
READ DATA FILE FOR N JOBS/PRODUCTS
FOR EACH JOB/PRODUCT J, J=N TO 1, INC=-1
- PRINT END-MARK AND CODE
- PRINT PATTERN AND INTERMEDIATE CODES, IF ANY
- PRINT START-MARK AND CODE
IF ALL JOBS ARE PRINTED, PRINT ROLL ID MARK AND CODE
10
14
11
PRINTER
13a
19
15a
13b
13c
15b
13
15
18
15c
17
L
C
S
RECOGNIZE ROLL-MARK AND READ CODE
VERIFY MATERIALS AND SETUP
ENABLE JOB PROCESSING
CODE READER READS MARK AND CODE
20
L+S
22
QUILTER
21
RECOGNIZE AND LOCATE START-MARK
CALCULATE CROP CUTOFF
RETRIEVE PATTERN FILE
REGISTER QUILTING HEAD
CALCULATE QUILT PATTERN MOTION SIGNALS
RECOGNIZE END MARK
CALCULATE PANEL CUTOFF
IF END-OF-ROLL, EXIT, OTHERWISE, LOOK FOR NEXT START-MARK.
REGISTER QUILT HEADS, QUILT PATTERN ADVANCE WEB
30
31
CUTTER
WEB FEED SENSORS
FROM CUTOFF CALCULATIONS AND WEB FEED, GENERATE CUTOFF SIGNALS FOR PANEL CUTTER
CUT CROP AND PANELS FROM WEB

BATCHWISE QUILTING OF PRINTED MATERIALS

This application claims the benefit of Provisional Application No. 60/361,127, filed Mar. 1, 2002.

This application is related to U.S. Pat. Nos. 5,873,315, 6,012,403; 6,158,366 and 6,263,816, and to U.S. patent application Publication No. 20010052312, all hereby expressly incorporated by reference herein.

FIELD OF THE INVENTION

This invention relates to the quilting of differently printed or otherwise differently prepared materials, and particularly to coordinating different quilting, panel cutting and cropping operations with the differently prepared materials introduced in a series into a quilting station and accommodating shrinkage of panel dimensions due to the quilting.

BACKGROUND OF THE INVENTION

Quilted panels used in the manufacture of comforters and mattress covers are typically decorated with patterns applied to a facing layer of a textile material, either by printing or by weaving or other processes in the textile manufacture. In many cases, some coordination is desired between the selection of a quilted pattern and the pattern that is printed or otherwise formed on the facing layer. Further, the patterns may be such that registration is desirable between the quilted and printed patterns.

The related patents and publications identified above, by the assignee of the inventors hereof, teach the combining of printing and quilting, the registration of quilted patterns with patterns otherwise applied to the quilted material, and the batching of different products formed of different combinations of coordinated patterns in the course of quilt manufacturing.

Furthermore, other patents of the inventors' assignee describe considerations and problems associated with quilting, such as the need to accommodate shrinkage or the gathering of material that occurs when compressible layers of fabric are sewn into quilts. Such problems include the control and coordination of the length of material fed from a web into the quilter with the cutter that severs the quilted panels from the web. Such patents include U.S. Pat. Nos. 5,154,130, 5,544,599 and 6,237,517, all hereby expressly incorporated by reference herein. These patents also refer to what are referred to herein as "batch" processes, in which quilting machines are controlled in such a way as to produce single or multiple panel batches of differing quilted products along a web of multi-layered material or on a continuously operating quilting line. A system for scheduling the manufacture of such products is further described in U.S. Pat. No. 6,105,520 of the assignee hereof, which is also expressly incorporated by reference herein.

The inventors' assignee has also taught the printing of textile substrates of the type useful for making quilted mattress covers and comforters. Such methods include those disclosed in U.S. Pat. No. 6,312,123 and U.S. patent application Publication Nos. 20010038408 and 2002005870, for example, which are hereby also expressly incorporated by reference herein. Such printing techniques are particularly useful in printing a variety of different patterns and information onto material for use in forming the quilted products referred to above.

When printing and quilting is to be combined and where economical commercial production of quilted and printed products is to be carried out, the problems that arise in each of the subsystems combine to produce new problems that are not addressed by solutions that focus on the problems of each subsystem alone. Among these problems are those that the shrinkage and cropping issues add to quilting-printing pattern coordination and to pattern registration.

SUMMARY OF THE INVENTION

A primary objective of the present invention is to provide for economical commercial production of quilted and printed products. A further objective of the invention is to efficiently solve problems that arise in combining scheduling, printing, quilting and cutting operations in the production of quilts. A particular objective of the invention is to solve problems that arise due to shrinkage of material during quilting and the need for cropping between quilting panels in performing quilting-printing pattern coordination and pattern registration.

According to principles of the present invention, a machine readable file is prepared for use in operating a print line that produces a layer of material having a series of panels printed thereon for quilting. The print line produces the material for quilting with machine readable records placed thereon. A quilt line receives the material, reads information from the records, and quilts the panels in accordance with the information.

In accordance with one aspect of the invention, the printing line produces the material having the series of panels thereon, preferably in an order that is the opposite of that in which the panels are to be quilted. The material may be in web form and, after printing, would be upon a roll such that the material can be fed from the roll, last-printed panel first, into a quilter. The printer may be in part controlled by information read from the machine readable file, with other of the information from the machine readable file being printed or otherwise placed in the records on the material.

In accordance with other aspects of the invention, the machine readable file includes information on one or more of the following: the order in which panels are to be quilted; the amount of shrinkage that will occur to a panel during quilting; the amount of crop to be made between adjacent panels following quilting. Such information may be included in records placed on the material at the print line. Such information is then in a condition to be read by a sensor at a quilting station, which reads the information and controls a quilter to quilt in accordance with the information. Panels are then quilted in accordance with a schedule and in batches in a most efficient manner. A panel cutter is also controlled by information read from records on the material. Shrinkage is also compensated for and appropriate crops are made between panels.

The invention provides a quilt manufacturing system that eliminates errors by human operators. Throughput of the machine and overall productivity are enhanced by reducing the need to change one or more of the materials that are otherwise required to be changed when different products or product batches are produced in sequence. The increased machinery run-time that results increases the quantities of products that can be produced, while operator stress and fatigue levels are reduced. Further, shrinkage of the panels and crops between panels are handled accurately, even as these parameters differ from panel to panel.

These and other objectives and advantages of the present invention will be more readily apparent from the following detailed description of the drawings of the preferred embodiment of the invention, in which:

BRIEF DESCRIPTION OF THE DRAWINGS

The FIGURE is a diagrammatic representation of an embodiment of the present invention.

DETAILED DESCRIPTION OF THE DRAWINGS

The embodiment of the invention illustrated in the figure provides for direct and automatic inputting of production information into a quilting system. The information is input automatically to a quilting machine controller from machine-readable records on the material being quilted. Such records may be in a form such as a bar code or other optically readable medium that can be read by bar code scanners or readers or by other optical sensors. However, types of media other than optically readable media, as for example, mechanically or magnetically readable media, can also be used, as well as other media that are or may become available with advancements in technology. The coded information in such records may be contained on labels affixed to the materials or may be printed or otherwise written or otherwise applied onto the materials themselves.

Illustrated in the figure is a web of top goods, for example, a mattress ticking material 11, to which such records of information 13 are to be applied. The web 11 is loaded onto a printing line 10 at which decorative patterns 15 and the records of information 13 are to be applied. The web 11 is usually supplied on a supply roll 12 and is typically of a textile material suitable for use as the top layer that will be quilted with several other layers of materials that may include a foam, fiber fill and backing material. The information in the records 13 in the form of a machine readable record 13 may be applied to any of these layers, but is most conveniently applied to this top layer 11. The information bearing concept also can be applied to any layer of quilted material and to other types of quilted and layered products, but advantages are particularly obtained by applying the information to the printed layer.

The information may be placed on the web 11 by way of a separate label or applied directly onto the material itself, such as by printing, and can be located anywhere within the confines of the material where it can be read by a scanner device. When placed in some locations, it is desirable that such labels or coding be capable of easy removal so as not to detract from the appearance or quality or value of the final product. Preferably however, the labels, either additionally affixed to or printed on the materials themselves, will be placed in a non-use zone within the confines of the material and still aligned to the area designated as the area that will pass by the scanning device. Such a zone includes, for example, the selvedge areas or strips 17 along the longitudinal edges of the web 11.

In the illustrated embodiment, the web 11 is fed to a printer 14 which prints a rectangular mattress panel 15 with a decorative pattern. A series of different panels 15*a*, 15*b*, . . . may be printed with the same or different patterns in accordance with an order by a customer who might be, for example, a bedding manufacturer. Such differences among the patterns printed on the panels 15 on the web 11 might be for the purpose of satisfying particular job or batch requirements of the customer. The pattern sequence is best when applied in an order that most efficiently satisfies production scheduling criteria. The printer 14, which may be a program controlled ink jet or other direct digital printer, is capable of producing individual patterns on demand and applying small quantities of each of several different patterns in sequence or other arrangement on the material. In the preferred embodiment of the invention, this printer 14 also prints the coded records 13 onto the material 11.

The records 13 may include appropriate symbols to be read and translated by a scanner or reading device. The information in the records may include an identifier of the job or batch for which the panel is intended, the material composition, a sequence number, a product identifier, or any other desired or required information that can be used to link to production, scheduling or various databases, or can be otherwise used in the quilt or other product manufacturing process. Such information is, in the illustrated embodiment, that which can be automatically input into a quilter, cutter or other machine in the quilt manufacturing process. This information is placed on the web 11 in a form and format that can be sensed, read or scanned, in accordance with the requirements of the applicable scanner and/or reading device that will be used to acquire the information at a quilting machine 21, for example, located in a separate quilting line 20.

The devices for the scanning and reading of the information can be of any particular type, according to the current technology available at the relevant time. Such scanning devices may be either stationary or portable, can be configured to work while scanning the materials in the process move into the field of view of the scanning device, or if the scanning device is manually moved into the area where the labels are attached or in motion, during the process. In the illustrated embodiment, an optical scanner 22, such as a bar code reader, is located at the quilting machine 21 adjacent the selvage edge of the web 11.

While the materials are described in the form of a web 11 unwound from supply roll 12, they may alternatively be in other forms such as single sheets of material. The concepts apply to roll-to-roll, roll-to-panel and sheet-to-panel quilting systems and may be applied to particular technologies other than quilting where multiple materials are to be joined in the process. Said processes might also, for example, entail the application of labels or printed information for a particular material, a particular job, or a product. In the illustrated embodiment, the web of material 11 is supplied to the printer 14 from the supply roll 12, and after being printed is wound onto a take-up roll 18. The web 11 is printed in an order that is the reverse (15*c*, 15*b*, 15*a*) of the order (15*a*, 15*b*, 15*c*) in which the panels 15 printed thereon will be quilted. The panels 15 are printed backward and the code 13*b* adjacent the end of the panel 15 is printed at the upstream end of the panel 15 on the print line 10, with the code 13*a* being printed at the downstream end of the panel 15 on the print line 10.

The records 13 can be placed in any number on the web 11, but preferably at least one record 13 is placed on the web 11 for each panel 15. In the preferred configuration, the records 13 are placed in an exact relationship to the location of the panel 15, which can facilitate the use of the records 13 for registration of quilting and cutting operations with the panels 15. In the specific configuration illustrated in the figure, a pair of records 13 is applied to the web 11 for each panel 15, one record 13*a* at the beginning panel that specifies the start of the panel 15 and one record 13*b* at the end of each panel 15. A record 13 can additionally or alternatively be applied to the web 11 for each job or batch of panels 15 or at the beginning and end of each job or batch of panels 15. The panels 15 can be of any of a plurality of various sizes and quantities and can vary from panel to panel along the web 11.

Intermediate records 13*c*, between the illustrated locations of the records 13*a* and 13*b* can be applied. Such intermediate records 13*c* can be useful in, for example, centering "panel-centric" patterns, which are those quilts, typically in the form of comforters and higher-priced mattress covers, in which a quilt-pattern and print-pattern are centered in registration on the panel. Such intermediate records 13*c* can provide a reference or registration mark for use in registering the patterns with each other on the center of the panel.

Between each of the panels 15, a panel cutter 31 or other device at a cutting station 30, which may be located on the quilting line 20 downstream of the quilter 21 or in a subsequent cutting line, executes a cut to sever the product that is quilted adjacent or a panel 15. As such, adjacent panels are physically and actually separated form each other. Such a cutting operation is preferably automatically accomplished at the end of the quilting operation, as described herein, and as described in U.S. Pat. Nos. 5,544,599 and 6,237,517 referred to above. In the absence of the appropriate mechanical devices or equipment to accomplish this, the cutting operation can be a accomplished as a secondary operation, off-line from the quilting line 20 and process herein being described. In the case of layered materials such as quilts that are subject to shrinkage in the quilting process or dimensional degradation of any other sort, use of a separate cutting line is a less desirable option for delivering quality products in the most cost effective manner.

The printing line 10 can be located at the same facility as the quilting line 20, either in a separate line or in-line in a combination print and quilt line. This may be the case in larger quilt manufacturing facilities or other facilities that specialize in high-end custom products. Many bedding manufacturers will, however, operate only the quilting lines 20 and will order the rolls 18 carrying the webs of material 11 having the panels 15 printed thereon according to their specific orders and specifications. This is best accomplished by the bedding manufacturer providing the printing facility with a data file 44 that is generated by a data preparation process 40 performed at or under the control of the bedding manufacturer.

One consideration of the bedding manufacturer in preparing the data file to the printer is accounting for the shrinkage or dimensional shortening of the web 11 during the particular quilting process that will be performed at the quilting facility. The operator of the quilting facility has the best information on the particular quilting process being used and of the parameters affecting the shrinkage.

Shrinkage, for example, being that dimensional change that occurs in the course of quilting layers of component materials together, such as for the purpose of manufacturing a mattress, box-spring covering, or other associated products, is brought about of several factors that make up the operation of the process. These factors include selection of materials specific to but not mandated by the makeup of the intended product, such as the filler components and the layered sequence in which they are placed, and the top and bottom layers, that is, the "ticking" and "backing" materials respectively. This layering of materials between ticking and backing constitutes the makeup of the materials for the product being produced.

The quilting machines 20, on which the quilted products are produced, function such that production occurs in a sequential fashion, one product after another. The sequential nature of this production process, has, in the past, caused the operators of the machinery, or other personnel, such as those hired specifically for the task, to change, splice, and otherwise modify the materials in the sequence of jobs moving through the system. The most often of these materials to be changed, which therefore is the major causation for loss of machine run-time, has been the top materials referred to as the "ticking". The responsibility of the operator is to not only secure the change of the material, but to make these changes at the proper time, such that a minimal amount of time is wasted. By printing different patterns onto the same web 11, these inefficiencies are largely avoided. However, doing so compounds the effect of the shrinkage factor, which not only can inject additional error where there is less operator intervention, but can vary along the web as the quilt patterns are changed.

The preparation of the print-data file 44 is therefore carried out preferably at the quilting facility by a process 40 in which the quilting jobs to be preformed on a quilting line 20 are batched and arranged in the order most suitable for quilting. A scheduler person enters job and product data 41 into a computer that might also have linked to it a number of database files, for example a product database 42 and a pattern database, which will be accessed by the scheduler or a program 43 in the computer which can calculate certain control parameters for the print-data file 44. For example, the entry of data defining the materials along with data defining a quilt pattern plus additional data of other quilting parameters can be processed by the computer to calculate shrinkage for each of the different panels 15, which shrinkage could differ from panel to panel. Additionally, the sequence or order in which the panels 15 are quilted affects the amount of crop needed for a transition from one panel to another on the quilter 21. Consecutive identical panels might, for example, require less transition distance, and thus less crop material between panels, than a drastic difference in the quilt patterns between two consecutive panels. The computer determines each of the parameters necessary to be communicated to the quilter to properly feed and quilt the batches of jobs on the web 11. The computer also may determine other information to be communicated to the printer, which will be read by a control program 48 in the controller of the printer 14 to properly print the patterns on the web 11 that will be quilted and to print the records 13 onto the web 11 that will be read by the sensor 22 of the quilter 21. All of this information is sent to the printer so that the web 11 will be printed in the reverse order, so that it is wound upon the roll 18 to be delivered to the quilting line 20 without the need to rewind the roll. The panels 15 and records 13 are thus printed on the web 11 in a First-In-Last-Out order.

Further, according to the preferred embodiment of the invention, a method is implemented that allows the quilting system at the quilt line 20 to track and signal for changes automatically. This tracking can utilize batching and scheduling concepts discussed in U.S. Pat. Nos. 5,544,599 and 6,237,517 and 6,105,520. The ticking is pre-processed with information including the amounts needed for the appropriate number of jobs that can fit on a roll, as well as the amount of material that will be required for normal shrinkage of the sewing layers of materials, as well as the amount of crop and selvedge needed to be removed by the cutting system, either in-process or as a secondary operation, in order to still produce quality products with a minimum of waste, and a maximum of system throughput.

The roll of ticking 18 which has been printed with the appropriate job information within the proper zone from which the scanner or appropriate reader can acquire the data, is delivered to the quilting line 20. This roll 18 contains on it, via the printing process, the appropriate patterns, shapes, colors, etc., that a customer, or user of the equipment will process through the quilting system at the quilt line 20 to produce the desired product end results. This pre-printed and information-bearing ticking replaces the standard ticking that must go through a pre-processing operation whereby the amount of ticking for the appropriate jobs that is to be quilted is spliced from different pattern bearing sections and wound onto a roll. The single spliced roll of product-based ticking may contain one or many different tickings, spliced together in the desired running sequence, and with enough ticking material to accommodate the shrinkage and crop-out values that have to be empirically determined during the course of running the products through the system. With the batch printed and coded roll 18, this same ticking roll strategy incorporates printed or attached machine-readable records, whereby the entire package of what is on the ticking roll is able to be ascertained via code reader 22 from the records 13. The overall batching information is preferably added to the printed roll 18 in the form of a master label 19 that is preferably affixed to the end of the web 11 on the roll 18 rather than being in the form of a record printed directly onto the printed ticking, although it can be so printed. In this way, when the roll 18 is first loaded onto the print line 20, the sensor 22 or another sensor for that purpose reads the roll label 19 and loads information into the quilter controller or another computer at the quilting station. Before quilting, all set ups can be prompted and executed and the material and settings verified. The quilting system, so equipped, thereby knows when to start and stop each successive job by the information that is automatically scanned during said running of the machine.

Implementation of the system and method described above results in a roll 18 of the web 11 being preprinted with panels 15 and coded records 13 printed on the web 11 in reverse order and being wound onto the roll 18, with a roll index label or record 19 at the accessible end of the web 11 upon the roll 18. The panels 15 on the unquilted web 11 have a length equal to the length L that the finished quilted panels are to have plus an additional length S to accommodate for the shrinkage. The printed image will be longitudinally scaled or stretched, typically uniformly, to a printed image length of L+S. In addition, the printed images will be spaced by a distance C equal to the dimension required for the crop between any two panels. These dimensions may all vary from panel to panel.

Those skilled in the art will appreciate that the application of the present invention herein is varied, that the invention is described in preferred embodiments, and that additions and modifications can be made without departing from the principles of the invention. Therefore, the following is claimed:

What is claimed is:

1. A method of quilting a material having printing thereon comprising:

feeding, into a quilting station of a quilting machine, a layer of a material having coded information thereon that relates to a product to be quilted on the material, the layer of material having one or more of the following properties:

the material has printed thereon a series of panels printed on the material and wound onto a roll in an order that is opposite the order in which the panels are to be quilted, the coded information contains information of the amount of shrinkage expected to occur during quilting and the layer of material has printed thereon one or more panels having a longitudinal dimension increased by said amount, and the coded information contains information of the amount of crop to be made between adjacent ones of a plurality of panels to be quilted from the layer of material;

reading the coded information from the material with a sensor at the quilting machine;

quilting the material at the quilting station in accordance with the information read from the material with the sensor.

2. A method of claim 1 further comprising:

selecting from a memory at the quilting machine one of a plurality of patterns; and quilting the material with the selected one of the patterns.

3. A method of claim 1 further comprising:

registering the quilting of the material with the printing on the material in accordance with the information read from the material with the sensor.

4. A method of claim 1 further comprising:

reading the coded information from the material with a sensor and cutting quilted panels from the material in accordance with the information.

5. A method of claim 1 further comprising:

reading the coded information from the material with a sensor and cutting cropping material from the material between quilted panels in accordance with the information.

6. A method of claim 1 further comprising:

providing a machine readable file to a material printing facility that includes batch printing information of a sequence of panels to be printed onto the material and information to be encoded onto the material in machine readable records.

7. A method of claim 1 further comprising:

producing a machine readable file that includes the coded information of a sequence of panels to be printed onto the material and information to be encoded onto the material in machine readable records;

printing a series of panels on the web in response to a reading of the machine readable file;

placing on the web, in response to a reading of the machine readable file, the coded information in coordination with the printed panels.

8. A method of claim 7 further comprising:

winding the web onto a roll in the order in which they are printed and feeding the roll, last printed panel first, into the quilting station and quilting the web in a sequence opposite that in which the panels are to be quilted.

9. A method of preparing a web of material for quilting comprising:

printing a series of panels on the web in a sequence opposite that in which the panels are to be quilted;

placing information on the web in coordination with the printed panels;

winding the web onto a roll in the order in which the panels are printed.

10. A roll of material made according to the method of claim 9 wherein:

the information placed on the web includes machine readable records, each corresponding to one of the printed panels of the series, and containing information relating to the quilting of the corresponding panel, being in a condition to be read by a sensor at a quilting machine, and being of a nature to affect the operation of a quilting machine, when the records are read at the quilting machine, in quilting each said corresponding panel in accordance with the information.

11. The method of claim 9 further comprising:

loading the roll onto a quilting line;

feeding the web from the roll to the quilting line;

quilting the panels on the web in a sequence that is the opposite of that in which they were printed.

12. The method of claim 9 wherein:

the information placed on the web is printed on the web at a print line on which the panels are printed.

13. A roll of material made according to the method of claim 12 wherein:

the information placed on the web in coordination with the printed panels includes information printed at the print line of the same print media in which the panels of the series are printed and includes quilting-machine-readable records containing information relating to the control of a quilting machine in quilting, in accordance with the information, the panels to which the respective records correspond.

14. The method of claim 9 wherein:

the information placed on the web includes information of an amount of shrinkage to be accommodated during quilting; and the panels are printed having a length larger than the panels to be quilted by an amount of the shrinkage to be accommodated.

15. A roll of material made according to the method of claim 14.

16. The method of claim 14 further comprising:

loading the roll onto a quilting line;

feeding the web from the roll to the quilting line;

quilting the panels having a length reduced from their printed lengths by the amount of such shrinkage.

17. A facing material for use in quilting comprising:

a textile web wound in a roll, the web having a series of lengths thereof, each of a plurality of the lengths having a printed image thereon;

each of a plurality of the printed images including a panel formed of a print medium, and a quilting-machine-readable record corresponding to the panel and formed of the same print medium as the panel;

the quilting-machine-readable records containing quilting-machine control information relating to the quilting of the corresponding panel, the information being in a condition to be read by a sensor at a quilting machine and of a nature that will affect the operation of the quilting machine in quilting, in accordance with the information, the corresponding panels when the web are fed to the quilting machine; and the quilting-machine control information contained in the quilting-machine-readable records being selected from the group consisting of:

the order in which panels are to be quilted, the amount of shrinkage that will occur to a panel during quilting, and the amount of crop to be made between adjacent panels following quilting.

* * * * *

UNITED STATES PATENT AND TRADEMARK OFFICE

CERTIFICATE OF CORRECTION

PATENT NO. : 6,796,254 B2
DATED : September 28, 2004
INVENTOR(S) : James Bondanza et al.

It is certified that error appears in the above-identified patent and that said Letters Patent is hereby corrected as shown below:

Column 3,
Line 40, "selvedge" should read -- selvage --.

Column 4,
Line 48, "can be of any" should read -- can be any --; and
Line 65, "separated form each" should read -- separated from each --.

Column 5,
Line 4, "can be a accomplished" should read -- can be accomplished --; and
Line 34. “Is brought about of several factors" should read -- is brought about by several factors --.

Column 6,
Line 36, "selvedge" should read -- selvage --.

Column 7,
Lines 45-50, The last two paragraphs should not be indented twice.

Column 8,
Line 19, "winding the web onto a roll in the order in which they are" should read -- winding the web onto a roll in the order in which said panels are --.

Column 10,
Line 6, "are fed to the quilting machine" should read -- is fed to the quilting machine --.

Signed and Sealed this

Seventh Day of June, 2005

JON W. DUDAS
*Director of the United States Patent and Trademark Office*